US011698169B2

(12) United States Patent
Hodgson et al.

(10) Patent No.: US 11,698,169 B2
(45) Date of Patent: Jul. 11, 2023

(54) VESSEL FOR THE TRANSPORT OF LIQUEFIED GAS AND METHOD OF OPERATING THE VESSEL

(71) Applicant: SHELL OIL COMPANY, Houston, TX (US)

(72) Inventors: Mark Andrew Hodgson, London (GB); Stephen Andrew Brown, London (GB)

(73) Assignee: SHELL USA, INC., Houston, TX (US)

( * ) Notice: Subject to any disclaimer, the term of this patent is extended or adjusted under 35 U.S.C. 154(b) by 924 days.

(21) Appl. No.: 16/471,075

(22) PCT Filed: Dec. 19, 2017

(86) PCT No.: PCT/EP2017/083597
§ 371 (c)(1),
(2) Date: Jun. 19, 2019

(87) PCT Pub. No.: WO2018/114981
PCT Pub. Date: Jun. 28, 2018

(65) Prior Publication Data

US 2019/0323659 A1 Oct. 24, 2019

(30) Foreign Application Priority Data

Dec. 23, 2016 (EP) ..... 16206573

(51) Int. Cl.
*F17C 1/00* (2006.01)
*F17C 13/00* (2006.01)
*F25J 1/00* (2006.01)

(52) U.S. Cl.
CPC ..... *F17C 1/002* (2013.01); *F17C 13/002* (2013.01); *F25J 1/0025* (2013.01);
(Continued)

(58) Field of Classification Search
CPC .. F17C 1/002; F17C 13/002; F17C 2201/052; F17C 2221/033; F17C 2223/0123;
(Continued)

(56) References Cited

U.S. PATENT DOCUMENTS 3,302,416 A 2/1967 Proctor et al.
5,121,609 A 6/1992 Cieslukowski
(Continued)

FOREIGN PATENT DOCUMENTS

CN 1566741 A 1/2005
CN 1898127 A 1/2007
(Continued)

OTHER PUBLICATIONS

Ship Design Practical Handbook, Volume of General Design, 3rd Edition, China State Ship building Corporation Limited, National Defense Industry Press, Aug. 31, 2013, 11 pages.
(Continued)

*Primary Examiner* — Atif H Chaudry
(74) *Attorney, Agent, or Firm* — Shell USA, Inc.

(57) ABSTRACT

A vessel for the transport of liquefied gas has a hull, a cargo storage tank arranged in the hull for storing liquefied gas and an engine to propel the ship. A compressor has a compressor inlet connected to a vapour space of the at least one cargo storage tank for receiving boil-off gas at a first pressure and a compressor outlet for supplying pressurized boil-off gas to the at least one engine at a second pressure exceeding the first pressure. A boil-off gas recovery system is provided for recovery of boil off gas. The boil-off gas recovery system has a cooling section with a cooling section inlet connected to the compressor outlet to recondense at least part of the pressurized boil-off gas and a boil-off gas storage tank
(Continued)

having a boil-off gas storage tank inlet connected to the cooling section outlet for storing the recondensed pressurized boil-off gas.

9 Claims, 7 Drawing Sheets

(52) U.S. Cl.
CPC .. *F17C 2201/052* (2013.01); *F17C 2221/033* (2013.01); *F17C 2223/0123* (2013.01); *F17C 2223/0161* (2013.01); *F17C 2223/033* (2013.01); *F17C 2223/043* (2013.01); *F17C 2223/046* (2013.01); *F17C 2225/0161* (2013.01); *F17C 2225/033* (2013.01); *F17C 2225/035* (2013.01); *F17C 2225/044* (2013.01); *F17C 2225/046* (2013.01); *F17C 2227/0135* (2013.01); *F17C 2227/0157* (2013.01); *F17C 2227/039* (2013.01); *F17C 2227/0339* (2013.01); *F17C 2250/01* (2013.01); *F17C 2265/034* (2013.01); *F17C 2265/066* (2013.01); *F17C 2270/0105* (2013.01)

(58) Field of Classification Search
CPC ..... F17C 2223/0161; F17C 2223/033; F17C 2223/043; F17C 2223/046; F17C 2225/0161; F25J 1/0025
USPC ..... 62/611
See application file for complete search history.

(56) References Cited

U.S. PATENT DOCUMENTS

| | | | | |
|---|---|---|---|---|
| 5,228,295 | A | 7/1993 | Gustafson | |
| 5,325,894 | A | 7/1994 | Kooy et al. | |
| 5,360,139 | A | 11/1994 | Goode | |
| 5,415,001 | A | 5/1995 | Powars | |
| 5,590,535 | A | 1/1997 | Rhoades | |
| 5,771,946 | A | 6/1998 | Kooy et al. | |
| 8,959,930 | B2 | 2/2015 | Lee et al. | |
| 8,973,398 | B2 * | 3/2015 | Coyle | F17C 9/02 62/611 |
| 9,739,420 | B2 | 8/2017 | Lee et al. | |
| 2007/0068176 | A1 | 3/2007 | Pozivil | |
| 2007/0068177 | A1 | 3/2007 | Higginbotham et al. | |
| 2008/0276627 | A1 | 11/2008 | Lee et al. | |
| 2008/0308175 | A1 * | 12/2008 | Lee | F17C 13/004 141/11 |
| 2010/0139316 | A1 | 6/2010 | An et al. | |
| 2011/0056238 | A1 * | 3/2011 | Mak | F25J 1/004 62/48.1 |
| 2012/0102978 | A1 | 5/2012 | Lee et al. | |
| 2013/0139544 | A1 * | 6/2013 | Mak | F17C 9/02 62/611 |
| 2013/0174583 | A1 | 7/2013 | Lee | |
| 2014/0060110 | A1 | 3/2014 | Jung et al. | |
| 2014/0069118 | A1 * | 3/2014 | Jung | F02M 21/0215 62/48.1 |
| 2014/0250922 | A1 | 9/2014 | Kang et al. | |
| 2014/0318159 | A1 | 10/2014 | Eisenhour | |
| 2015/0000334 | A1 | 1/2015 | Edwards | |
| 2015/0323237 | A1 | 11/2015 | Kim et al. | |
| 2015/0330574 | A1 * | 11/2015 | Fuchs | F25J 1/0265 62/48.2 |
| 2016/0195330 | A1 | 7/2016 | Seo | |
| 2016/0215930 | A1 * | 7/2016 | Nelson | F17C 13/082 |
| 2016/0216029 | A1 * | 7/2016 | Ragot | B63B 25/16 |
| 2018/0216877 | A1 * | 8/2018 | Dabkowski | F17C 7/04 |

FOREIGN PATENT DOCUMENTS

| | | | |
|---|---|---|---|
| CN | 101896780 | A | 11/2010 |
| CN | 104728605 | A | 6/2015 |
| CN | 204477679 | U | 7/2015 |
| CN | 104913196 | A | 9/2015 |
| DE | 102007042158 | A1 | 3/2009 |
| EP | 2464563 | A1 | 6/2012 |
| EP | 2496470 | A1 | 9/2012 |
| EP | 2706282 | A1 | 3/2014 |
| EP | 2896810 | A1 | 7/2015 |
| JP | H08170799 | A | 7/1996 |
| JP | H1163396 | A | 3/1999 |
| JP | 2003106498 | A | 4/2003 |
| JP | 2007155060 | A | 6/2007 |
| JP | 2008309195 | A | 12/2008 |
| JP | 2012516263 | A | 7/2012 |
| KR | 20100099441 | A | 9/2010 |
| KR | 101395876 | B1 | 5/2014 |
| WO | 9601391 | A1 | 1/1996 |

OTHER PUBLICATIONS

International Search Report and Written Opinion received for PCT Patent Application No. PCT/EP2017/083597 dated Mar. 19, 2018, 12 pages.

International Search Report and Written Opinion received for PCT Patent Application No. PCT/EP2016/082687 dated Mar. 22, 2017, 09 pages.

Office Action Received for Korean Application No. 10-2019-7017271, dated May 31, 2022, 27 Pages(16 Pages of English Translation and 11 Pages of Official Copy).

* cited by examiner 146
144
140
30
32
148
50
50
50
50
142

30
30
A
A
32B
32A
32C
32D
142

VESSEL FOR THE TRANSPORT OF LIQUEFIED GAS AND METHOD OF OPERATING THE VESSEL

CROSS REFERENCE TO RELATED APPLICATIONS

This is a US national stage application of International Application No. PCT/EP2017/083597, filed 19 Dec. 2017, which claims benefit of priority of European application No. 16206573.4, filed 23 Dec. 2016.

BACKGROUND OF THE INVENTION

The present disclosure relates to a vessel for the transport of liquefied gas. The vessel is provided with a system for handling boil off gas. The disclosure also relates to a method of operating the vessel.

The liquefied gas may typically be or comprise liquefied natural gas (LNG). The liquefied gas may be cooled to cryogenic temperatures, so it can be stored as a liquid and at reduced pressures. The LNG may be stored at about atmospheric pressure, typically about 1 bar, for instance when the gas has been cooled to about minus 163° C.

Generally, natural gas (NG) is turned into a liquid (also called liquefied natural gas or LNG) in a liquefaction plant, transported over long distances by an LNG carrier (a vessel) provided with storage tanks for the LNG, and regasified by passing a floating storage and regasification unit (FSRU) or an unloading terminal on land to be supplied to consumers.

As the liquefied natural gas is stored for transport at a cryogenic temperature of approximately −163° C. at ambient pressure, LNG is likely to evaporate even when the temperature of the LNG in the storage tanks is slightly higher than −163° C. at ambient pressure. Although an LNG storage tank of an LNG carrier is thermally insulated, as heat is continually transmitted from the outside to the LNG in the LNG storage tank, the LNG continually evaporates and boil-off gas (BOG) is generated in the LNG storage tank during the transportation of LNG by the LNG carrier.

If boil-off gas is generated in an LNG storage tank as described above, the pressure of the LNG storage tank will increase and may exceed a safety threshold level.

Conventionally, if the pressure of an LNG storage tank is increased beyond a set pressure, boil-off gas was discharged to the outside of the LNG storage tank and used as a fuel for propulsion of the LNG carrier, so as to maintain the pressure of the LNG storage tank at a safe level. However, a steam turbine propulsion system driven by the steam generated in a boiler by burning the boil-off gas generated in an LNG storage tank has a problem of low propulsion efficiency. This actually means that in practice, the steam plant may use more natural gas than just the available boil-off gas.

A dual fuel diesel electric propulsion system, which uses the boil-off gas generated in an LNG storage tank as a fuel for a diesel engine after compressing the boil-off gas, has higher propulsion efficiency than the steam turbine propulsion system.

However, efficient modern propulsion systems, such as the dual fuel diesel electric propulsion system, have a problem in case the amount of boil-off gas (BOG) generated in an LNG storage tank exceeds the capacity or current demand of the propulsion system. Typically, the amount of BOG exceeds the capacity of the diesel propulsion system when the vessel sails at a speed below a certain threshold, i.e. when the vessel moves a relatively low speed.

Additional equipment such as a gas combustion unit (GCU) is typically needed to consume surplus boil-off gas. This particular problem is aggravated in times of low spot prices for the LNG cargo, as LNG carriers will want to sail at reduced speeds to save fuel for transport.

On the other hand, there is another method of maintaining a pressure of an LNG storage tank at a safe level. If the pressure of the LNG storage tank is increased beyond a set pressure, boil-off gas is discharged to the outside of the LNG storage tank and reliquefied in a reliquefaction plant and then returned to the LNG storage tank.

U.S. Pat. No. 8,959,930 discloses a method and an apparatus for treating boil-off gas generated in an LNG storage tank of an LNG carrier for transporting LNG in a cryogenic liquid state. The LNG carrier has a boil-off gas reliquefaction plant, wherein an amount of boil-off gas corresponding to a treatment capacity of the reliquefaction plant among the total amount of boil-off gas generated during the voyage of the LNG carrier is discharged from the LNG storage tank and reliquefied by the reliquefaction plant.

The reliquefaction method of U.S. Pat. No. 8,959,930 can maintain an amount of boil-off gas discharged from an LNG storage tank at a constant level by reliquefying part of the boil-off gas and storing it in the LNG storage tank, instead of discharging and burning, and can prevent wasted boil-off gas and save energy.

US2010139316 by Deawoo likewise discloses a system wherein after pressurization, part of the boil off gas is cooled against a refrigerant, and stored at about 3 bar in a liquid separator. This is a re-liquefaction process using a separate refrigeration cycle.

However, the reliquefaction plant requires a significant amount of equipment, has a significant power demand and is relatively complex to operate, thus increasing both capital expenditure and operating expenditure. The reliquefaction system is really quite thermally inefficient, typically in the order of 18 to 20%. In addition, the reliquefaction equipment is relatively spacious and heavy, which is a significant disadvantage for application on a vessel, as it limits space available for cargo or other equipment and negatively impacts the overall fuel efficiency of the vessel. For instance due to the issues stated above, retrofit to existing LNG carriers is considered uneconomical.

EP2706282A1 discloses a boil-off gas processing apparatus for reliquefying a boil-off gas generated within a liquefied gas tank. After compression, part of the boil off gas is returned directly to the main cryogenic storage tanks via a return line. The return line is fitted with a pressure holding device configured to maintains a pressure necessary for reliquefaction of the boil-off gas. In the return line, the boil off gas is directly heat exchanged with the liquefied gas in the main storage tanks, and directly thereafter returned to the tanks. EP2896810A1 provides a liquefied gas treatment system for a vessel, which includes a number of storage tanks storing liquefied natural gas, and an engine using the liquefied natural gas stored in the tanks as fuel. Boil-off gas from the storage tanks is compressed at about 150 to 400 bara and is branched into a second stream and a third stream. The second stream is supplied as fuel to the engine. The third stream is cooled in a heat exchanger by exchanging heat with the boil off gas leaving the storage tanks without employing a reliquefaction apparatus using a separate refrigerant. The thus cooled third stream is decompressed and the decompressed third stream is in a gas-liquid mixed state, and its gas and liquid components are returned to the storage tanks.

As indicated above, operational practices can be optimised to mitigate the boil-off gas of LNG cargo to some degree. But it is a common issue across the LNG industry where the potential efficiencies of the machinery are not being realised.

Thus, there is a clear identified need for options that would enable the further reduction of the amount of gas being lost, and often sent to the gas combustion unit.

BRIEF DESCRIPTION OF THE INVENTION

The disclosure provides a A vessel for the transport of liquefied gas, comprising:

a hull;

at least one cargo storage tank arranged in the hull for storing liquefied gas;

at least one engine to propel the vessel;

at least one compressor having a compressor inlet connected to a vapour space of the at least one cargo storage tank for receiving boil-off gas at cargo tank pressure and a compressor outlet for supplying pressurized boil-off gas to the at least one engine at a second pressure exceeding the first pressure; and a boil off gas (BOG) recovery system for recovery of boil off gas, the BOG recovery system comprising:

a cooling section having a cooling section inlet connected to the compressor outlet to recondense at least part of the pressurized boil-off gas; and at least one recovery tank having a recovery tank inlet connected to the cooling section outlet for storing the recondensed pressurized boil-off gas.

In an embodiment, the BOG recovery system comprises a first pump arranged between the cooling section outlet and the recovery tank inlet.

In another embodiment, the cooling section comprises a recondenser having a recondenser inlet and a recondenser outlet for providing the recondensed pressurized boil-off gas.

In an embodiment, the cooling system comprises a pre-cooler section having a pre-cooler inlet connected to the compressor outlet and a pre-cooler outlet to provide pre-cooled pressurized boil-off gas to the recondenser inlet.

In an embodiment, the first pump is connected to the recondenser outlet, and the first pump has a first pump outlet for providing the recondensed pressurized boil-off gas. The first pump may be a fluid pump. The pressure at the outlet of the first pump may be in the range of about 5 Bar to 25 Bar.

In an embodiment, the first pump being connected to the recondenser outlet, and the first pump having a first pump outlet for providing the recondensed pressurized boil-off gas at a fourth pressure, the fourth pressure exceeding the third pressure, to a secondary pre-cooler inlet for heat exchange of the recondensed pressurized boil-off gas against the pressurized boil-off gas.

In an embodiment, the first pump outlet is connected to a secondary pre-cooler inlet for heat exchange of the recondensed pressurized boil-off gas against the pressurized boil-off gas and minimize undercooling of the recondensed gas.

In an embodiment, a secondary pre-cooler outlet is connected to the recovery tank inlet.

The cooling section may comprise a recondenser heat exchanger for heat exchanging the pressurized boil-off gas with part of the liquefied gas stored in the at least one cargo storage tank. The recondenser heat exchanger may be arranged inside the recondenser. The reconderser may be provided with spray headers to spray liquefied gas from the at least one cargo storage tank into the recondenser.

The recovery tank may be provided with a first spray header connected to the at least one cargo storage tank, the first spray header being adapted to spray liquefied gas into the recovery tank.

The cooling section may be provided with a second spray header connected to the at least one cargo storage tank, the second spray header being adapted to spray liquefied gas into the cooling section.

In an embodiment, the recovery tank has a first outlet connected to the at least one engine, for providing vaporized boil off gas from the recovery tank to the engine.

In another embodiment, the recovery tank has a second outlet connected to a second pump for pumping the recondensed pressurized boil-off gas to the at least one cargo storage tank.

In yet another embodiment, via the spray header the transfer pump can supply a forcing vaporizer. This will evaporate the recovered liquid at an appropriate rate to meet with the fuel gas demand.

According to another aspect, the disclosure provides a method for the transport of liquefied gas, comprising:

transporting liquefied gas in a vessel, the vessel comprising:

a hull, at least one cargo storage tank arranged in the hull for storing liquefied gas, at least one engine to propel the vessel;

receiving boil-off gas at a compressor inlet of at least one compressor, the compressor inlet connected to a vapour space of the at least one cargo storage tank, at a first pressure;

using the compressor to supply pressurized boil-off gas to the at least one engine at a second pressure exceeding the first pressure;

diverting at least part of the pressurized boil-off gas to a boil off gas (BOG) recovery system for recovery of boil off gas;

recondensing the at least part of the pressurized boil-off gas in a cooling section of the BOG recovery system to provide recondensed pressurized boil-off gas;

storing the recondensed pressurized boil-off gas in at least one recovery tank.

The method may comprise the step of providing vaporized boil-off gas from the at least one recovery tank directly to the at least one engine.

The liquefied gas may comprise liquefied natural gas (LNG).

BRIEF DESCRIPTION OF THE DRAWINGS

These and other features, aspects, and advantages of the present disclosure will be apparent from the following detailed description with reference to the accompanying drawings in which like characters represent like parts throughout the drawings. In the drawings.

DETAILED DESCRIPTION OF THE INVENTION

The following provides an exemplary outline of a practical application of the system and process of the present disclosure.

The determining factor in efficient LNG vessel operation is to balance the demand for fuel gas from the propulsion plant with the amount of BOG being generated by the cargo containment system. Any time that the supply of BOG exceeds the demand then wasteful practices such as steam dumping or GCU operation must be employed to balance the situation by burning the surplus gas rather than venting to atmosphere, as required by Chapter 7 of the IGC code.

The older generations of LNG carriers utilised a Steam propulsion plant, which has a number of advantages, but is thermally inefficient, with an efficiency at around 25%. Modern vessels employ a diesel plant, which has a higher thermal efficiency, typically between 40% and 50%.

Figure 1:
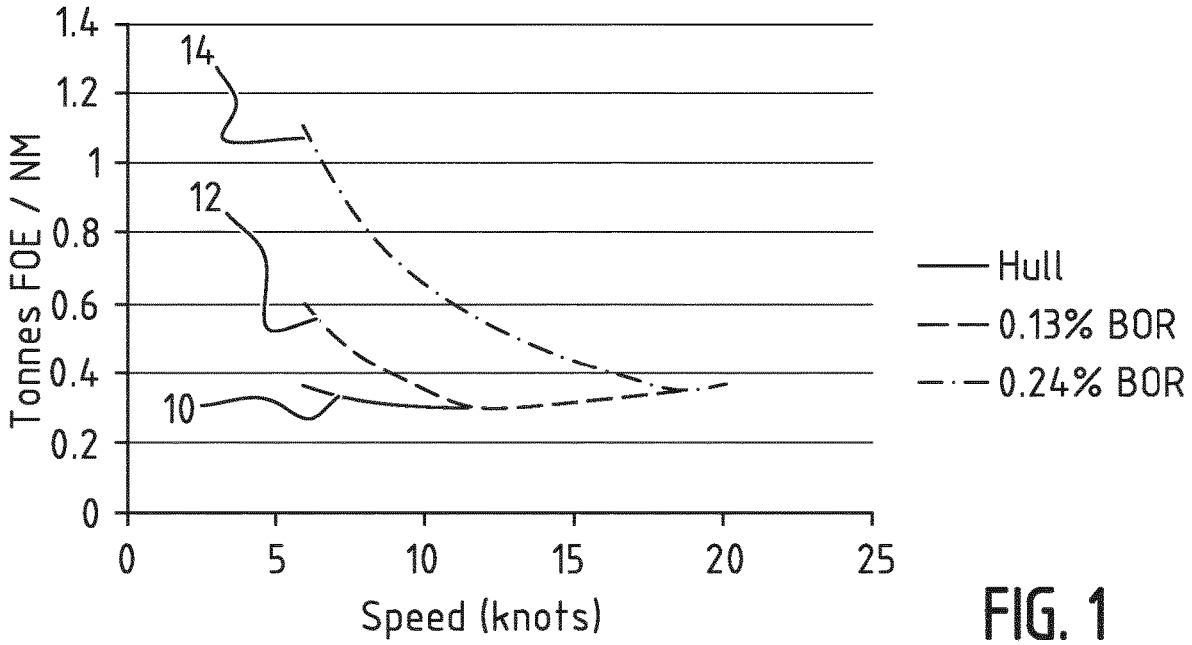
FIG. 1 shows an exemplary diagram of boil-off gas supply and demand (y-axis) versus speed (x-axis) for a conventional LNG carrier equipped with a steam turbine propulsion system.

FIG. 1 shows a diagram of boil-off gas supply and demand (y-axis, expressed in metric tonnes of fuel oil equipvalent per nautical mile [Tonne FOE/NM]) versus speed (x-axis, espressed in knots) for a conventional LNG carrier equipped with a steam turbine propulsion system. Storage tanks for liquefied gas have a total volume in the order of 138,000 m3. Demand curve 10 indicates the fuel demand of the propulsion system to propel the vessel at a certain speed. Supply curves 12 and 14 indicate the available boil off gas for a laden vessel, i.e. with storage tanks filled, for exemplary boil off rates (BOR) of 0.13% per day and 0.24% per day respectively. 0.24% per day herein means 0.24% of the total volume of the cargo (i.e. the liquefied gas) evaporates per day.

As indicated by supply curve 14, the historical LNG carrier is a highly powered vessel operating at high speed carrying a time dependent cargo. The efficiency curves for these early vessels resulted in vessels being programmed at high speed, typically speeds of about 18.5 knots and higher, as it was only at these speeds that the balance was achieved, i.e. that demand for fuel for the engines exceeded the available supply of BOG.

As indicated by supply curve 12, improved insulation has meant that hull and containment system characteristics on modern steam powered vessels are well matched. The vessels can be operated at speeds down to 12 knots without introducing additional inefficiencies and waste. Nevertheless, they remain inherintly thermally inefficient compared to diesel engines.

Figure 2:
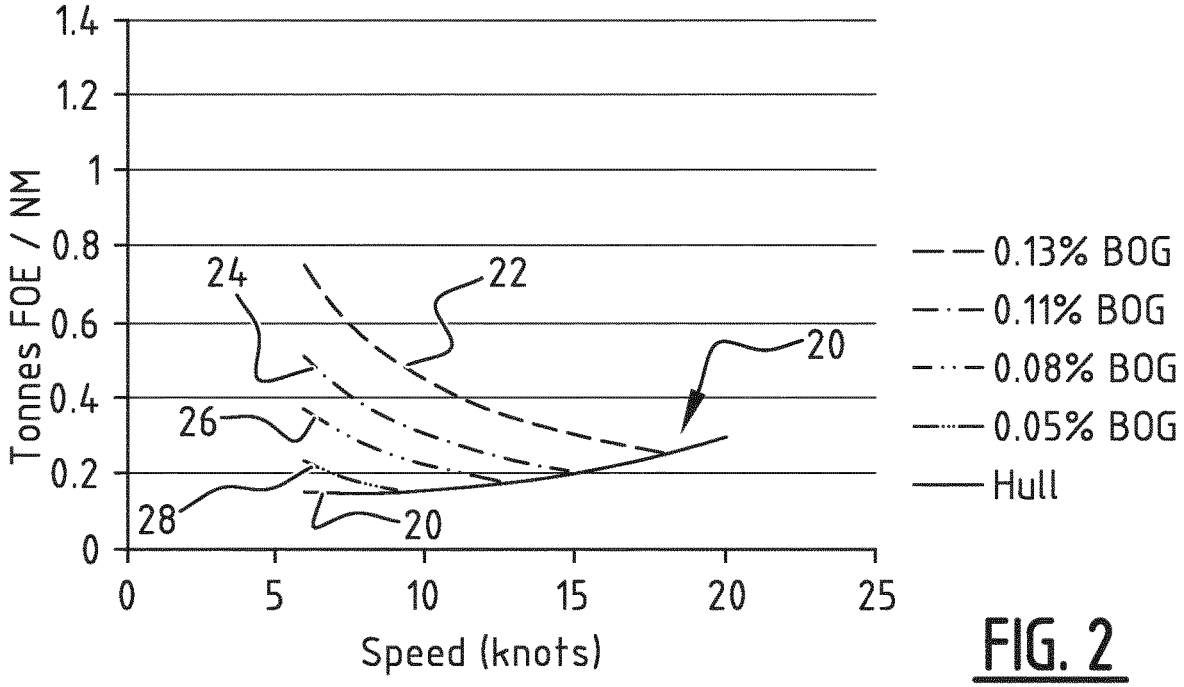
FIG. 2 shows an exemplary diagram of boil-off gas supply and demand (y-axis) versus speed (x-axis) for another conventional LNG carrier equipped with a duel-fuel diesel electric (DFDE) propulsion system.

FIG. 2 shows an exemplary diagram of boil-off gas supply and demand (y-axis, expressed in metric tonnes of fuel oil equipvalent per nautical mile [Tonne FOE/NM]) versus speed (x-axis, espressed in knots) for a more modern LNG carrier equipped with a duel-fuel diesel electric (DFDE) propulsion system. Storage tanks for liquefied gas have a total volume in the order of, for instance, 174,000 m3. Demand curve 20 indicates the fuel demand of the propulsion system to propel the vessel at a certain speed. Supply curves 22, 24, 26, and 28 indicate the available boil off gas for a laden vessel, i.e. with storage tanks filled, for exemplary boil off rates (BOR) of 0.13% per day, 0.11% per day, 0.08% per day, and 0.05% per day respectively. Break-even speeds are in the order of 18, 15, 13 and 9 knots respectively.

As indicated by FIG. 2, the installation of DFDE and ME-GI propulsion plants in modern vessels has reintroduced the mismatch, as these engines are more fuel efficient than steam turbines. This in turn means that a gas combustion unit (GCU) is routinely used to maintain the flow of boil off gas from the cargo tanks when the vessels are operated at lower speeds.

Gas burnt in the GCU performs no useful work, releases harmful emissions (such as CO2) and represents lost LNG that could otherwise be delivered to customers. The commercial structure of a typical charter agreement is such that the ship operators have no incentive to change this behaviour, and all loss is borne by the vessel charterers in the form of lost sales opportunities.

The programming of vessel speed depends on many variables, and vessel operators need to use the vessel at different speeds for different cargoes depending on Sellers and Buyers requirements. This particularly applies to vessels in the spot charter market, as many of these vessels often are. The challenges in scheduling the fleets in a long market greatly increases the benefit to traders of more flexibility in vessel speed.

There are measures through heel management which can be taken on Ballast voyages to reduce the BOG quantity, such as only retaining heel in one cargo tank, however these options are not available during the Laden passage.

There are possible solutions to the mismatch issue with increased insulation or reliquefaction equipment, with increased insulation being a passive approach for LNG carrier new-buildings that will minimise both emissions and losses.

However, LNG carriers are typically designed for a lifespan of several decades, meaning that currently employed vessels will remain in service for many years to come. The amount of LNG potentially consumed in the GCU during the life of these contracts is very significant indeed if current trends continue. Many of these vessels are equipped with fuel efficient engines, such as DFDE, TFDE or XDF configuration.

This effectively means that the savings offered by the more efficient power plant are not being fully realised.

Analysis of an existing LNG carrier fleet has quantified that a selection of, for instance, eight of the vessels, each fitted with a Diesel-electric propulsion plant, have in the course of one year burnt approximately 100,000 m3 of LNG in the on-board gas combustion unit (GCU) to control cargo tank pressures. In other words, this is a significant volume of lost cargo, while resulting in emissions of about 122,000 metric tonnes of CO2.

As explained above with respect to FIGS. 1 and 2, this behaviour is necessitated by a mismatch in the boil off fuel gas available and that required for propulsion in a flexible trading profile for these ships.

The options for LNG carrier new buildings may not be economical in view of the remaining lifetime of existing vessels and charter agreements. On the other hand, both reliquefaction and increased insulation pose significant challenges in the context of retrofitting existing vessels.

The present disclosure aims to capture BOG and hold the captured BOG on board in some manner for later consumption on board. This would apply, for instance, to excess BOG on a Laden passage being captured and then used during the subsequent Ballast passage. Herein, Laden passage means the passage with filled storage tanks, while the ballast passage is the return passage with almost empty storage tanks.

This process would effectively reduce the BOR and thereby increase flexibility in the programming of DFDE vessels and similarly relatively fuel efficient vessels in the laden condition.

The system of the present disclosure captures excess BOG during the Laden passage at times when the BOG from the containment system exceeds the demand from the engines. The captured excess BOG is stored as a liquid at a higher pressure than can be allowed in the main cargo tanks.

Figure 3:
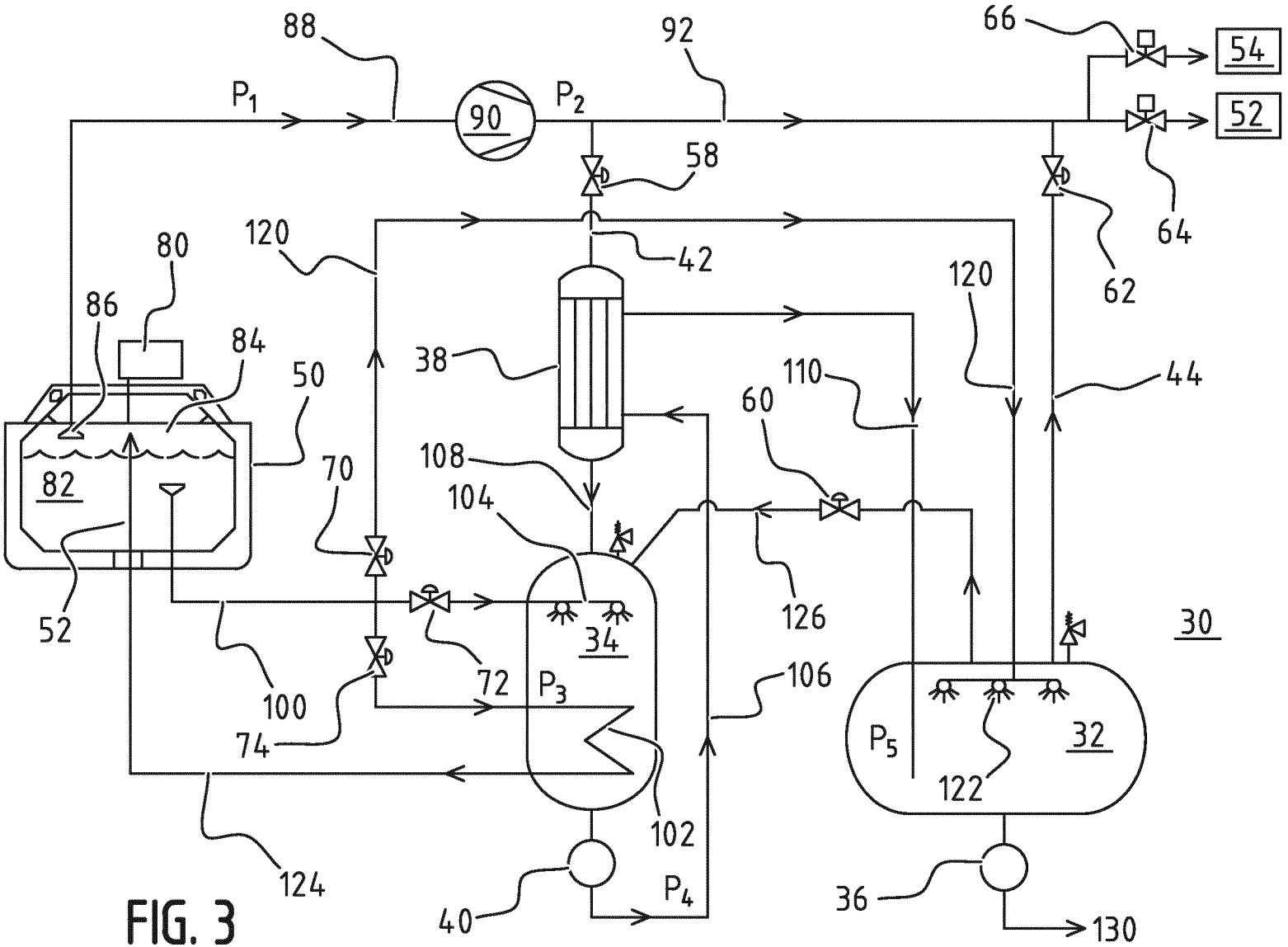
FIG. 3 shows a diagram of an embodiment of an energy recovery system of the present disclosure.

FIG. 3 shows an embodiment of a system 30 for capturing excess boil-off gas according to the disclosure. The system 30 may also be referred to as an Excess Energy Recovery System (EERS).

In a basic embodiment, the system 30 comprises a recovery tank 32. The system may also comprise a re-condenser 34 and a pump 36. The system comprises various pipelines to interconnect components, such as pipeline 42 connecting the system to cargo tanks 50 on one end and pipeline 44 connecting the system to to the machinery room fuel supply, leading to the consumers of the vessel such as the engines 52 and/or GCU 54, on the opposite end.

In an improved embodiment, one or more of the following pieces of equipment may be comprised in the system 30:

Pre-cooler 38;

Fluid transfer pumps 36, 40;

one or more gas valve units 58, 60, 62, 64, 66;

one or more cryogenic fluid valve units 70, 72, 74;

EERS control system 80.

In a practical embodiment, the one or more recovery tanks 32 may be so-called type C tanks. These tanks are also known as "cryogenic pressure vessels", as they store the liquefied gas at increased pressures with respect to atmospheric pressure. They are independent of the hull of the vessel, and are not essential for maintaining hull strength and integrity of the ship. This unlike the main storage tanks 50, which are typically membrane tanks or similar storage tanks, referred to as type A or B and are designed for storing liquefied gas at atmospheric pressure (about 1 bar).

Prefabricated vacuum-isolated cryogenic type C tanks are available in a wide range of sizes (for instance up to 500 m3). Maximum allowable working pressure may be up to the order of 20 bar. Available tank sizes are expected to increase significantly over the next few years (1,000-10,000 m3).

The system 30 can be connected to the existing equipment of a typical carrier vessel for liquefied gas. Such vessel would typically comprise one or more cargo storage tanks 50. The storage tank 50 typically stores liquefied gas 82 at about atmospheric pressure. As explained above, the liquefied gas may slowly evaporate, thus resulting in a pressure increase in the vapour space 84. A vapour header 86 may be provided in the vapour space to remove boil-off gas 88 from the vapour space to control the pressure in the vapour space 84.

The vessel may typically be provided with a gas compressor 90 to compress the boil-off gas and increase the pressure of the gas to a predetermined increased pressure. At the increased pressure, the pressurized BOG may be suitable for use by the engines 52 as a fuel. Thus, the BOG is provided at a first pressure $P_1$. The first pressure $P_1$ typically slightly exceeds atmospheric pressure. In a practical embodiment, the predetermined increased pressure $P_2$ may be between 2 Bar and 10 Bar.

Pipeline 92 connects the compressor 90 to the main consumers, such as engines 52 and GCU 54. Valves 64, 66 control delivery of the pressurized BOG to either the engine 52 of the GCU 54 respectively.

The system of the disclosure achieves a suitable increased pressure of the BOG by taking BOG from the discharge end of the Fuel Gas compressors 90 via pipeline 42. Valve 58 controls the amount of pressurized BOG diverted to BOG recovery system 30.

In a first step, the diverted pressurized boil-off gas is—at least partly—re-condensed by heat exchange against LNG 100 from the main storage tank 50 before being pumped to the recovery tank 32.

The re-condenser 34 will operate at a third pressure $P_3$. In practice, the third pressure inside the re-condenser 34 is about the Fuel Gas compressor pressure, i.e. the predetermined outlet pressure $P_2$ at the outlet of compressor 90. In a practical embodiment, the third pressure $P_3$ will be sufficiently lower than the second pressure $P_2$ to allow a certain flow of BOG from the compressor outlet to the re-condenser 34.

The recovery tank 32 will operate at a storage pressure $P_5$. The storage pressure may be selected in the range of about 2 Bar to 25 Bar. In a practical embodiment, the storage pressure $P_5$ may be selected in the range of 6 bar to 15 bar.

The BOG storage pressure $P_5$ will be achieved by liquid transfer pump 40. Thus, the diverted pressurized BOG is re-condensed and subsequently the pressure is increased to pump pressure $P_4$. The pump pressure $P_4$ sufficiently exceeds the predetermined storage pressure $P_5$ to arrive at the selected storage pressure. The one or more recovery tanks 32 store the BOG at least partly in liquid form at said storage pressure $P_5$.

The cooling LNG 100 will be removed from the cargo tank 50. In an embodiment, the LNG 100 may be provided to a heat exchanger 102 arranged in the re-condensor 34. Valve 74 may be provided to control the amount of LNG to the heat exchanger 102. The cooling LNG 100 will be returned to the main cargo tanks via pipeline 124, which will result in a slight increase in the temperature of the bulk liquid cargo 82 in the cargo tank 50.

In an improved embodiment, the system 30 includes a heat exchanger 38 to pre-cool the BOG 42. Pre-cooling the BOG against the recondensed BOG 106 can ensure that the amount of heat rejected to the liquid cargo in the re-condensor is minimised for the required storage conditions.

A first part of the cooling LNG 100 may be diverted via valve 72 to spray header 104 arranged in the re-condensor 34 to spray said diverted first part of the cooling LNG into the re-condensor 34. Liquefied gas, including the recondensed boil-off gas, is collected at the lower end of the recondenser 34.

Pump 40 pumps the liquefied gas 106 from the recondenser to the pre-cooler 38. The diverted BOG 42 exchages heat with the liquefied gas 106 in the pre-cooler 38. Subsequently, pre-cooled BOG 108 is directed to the re-condensor 34 to be recondensed as described above. After heat exchange with the diverted BOG and a slight temperature increase, liquefied gas 110 is directed to the recovery tank 32 to be stored at increased pressure.

In yet another embodiment, the system 30 may include valve 70 to divert a second part 120 of the cooling LNG 100 to spray header 122 arranged in the BOG recovery tank 32. The valve 70 herein may control the flow of LNG 120 to the spray header. Spraying LNG directly into the recovery tank 32 may allow to reduce the temperature of the liquefied boil-off gas stored in the recovery tank 32, and thus also reduce the pressure of the stored liquid.

In an embodiment, the recovery tank 32 may be coupled to the recondenser 34 via gas pipeline 126. Valve 60 in the pipeline 126 allows to release vaporized BOG from the recovery tank 32 and return it to the recondensor to be recondensed. This embodiment enables to control and reduce the pressure in the recovery tank 32. The recondensed BOG stored at above-atmospheric pressure in the recovery tank 32 can be used to, for instance:

- Provide fuel to the engines 52 on Ballast passage. Herein, valves 62 and 64 control flow of vaporized BOG 44 from the recovery tank 32 to the engines 52;
- Be mixed and discharged with the bulk liquid cargo 82 to customers. Herein, pump 36 controls discharge of liquified pressurized BOG 130. The liquified pressurized BOG 130 may for instance be directed to the cargo tank 50 for mixing with the main cargo 82. For instance, the liquified pressurized BOG 130 may be directed to fluid inlet 52 in the main cargo tank 50; and
- Spray cool cargo tanks 50 on Ballast passage. Herein, the liquified pressurized BOG 130 may be directed to a spray rail 52 in the cargo tank 50, to be sprayed into the vapor space 84.

FIGS. 4 to 7 show an exemplary, conventional LNG carrier 140, having hull 142, deck 144, fore end 146 and aft end 148. In an embodiment, the system 30 of the present disclosure can be fitted on the deck 144 of a conventional LNG carrier 142. One or more type C storage tanks 32 can be arranged between in series (such as tanks 32A, 32B in FIG. 5) and/or adjacent (tanks 32C, 32D in FIG. 5). The BOG storage tanks may be arranged on port side and/or starboard side (nautical terms for left and right, respectively, looking toward the front end of the vessel).

Figures 4, 5:
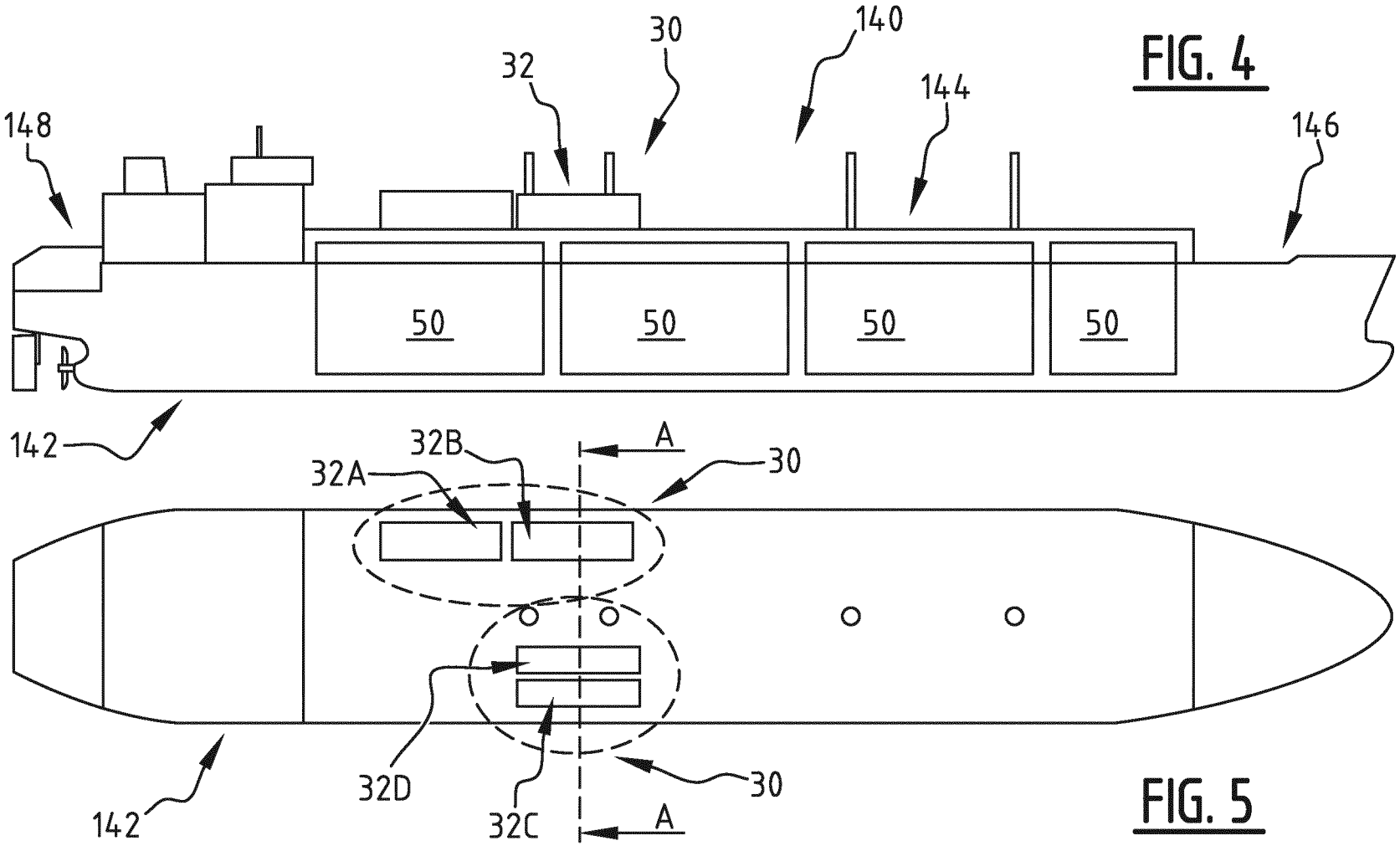
FIG. 4 shows a side view of an embodiment of a LNG carrier provided with an energy recovery system of the disclosure.
FIG. 5 shows a top view of an embodiment of a LNG carrier provided with an energy recovery system of the disclosure.
Figure 6:
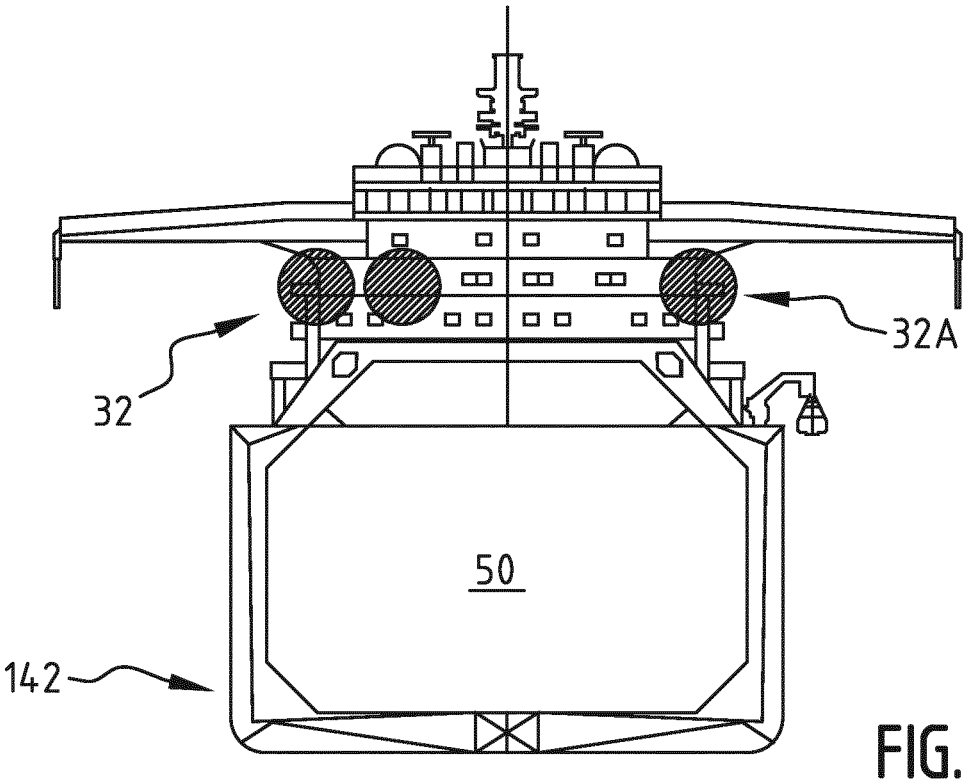
FIG. 6 shows a midship sectional view of the LNG carrier of FIG. 4.
Figure 7:
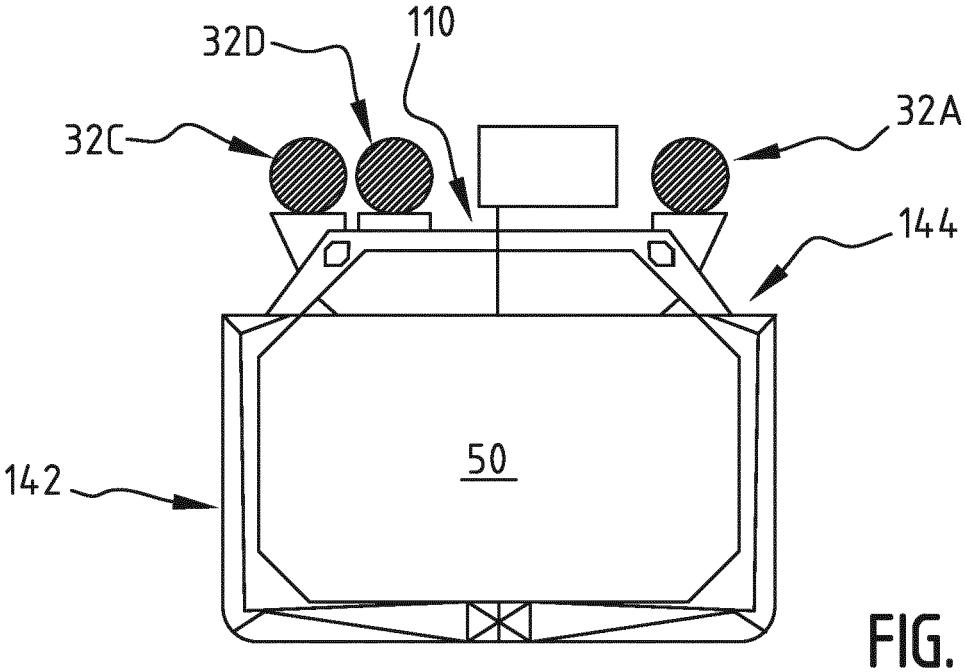
FIG. 7 shows a sectional view along line A-A of the LNG carrier of FIG. 5.

As indicated in FIGS. 4 and 5, the storage capacity of system 30 may be relatively limited compared to the storage capacity of the total volume of the cargo tanks 50. As elucidated below, even a relatively limited storage volume for (recondensed and compressed) boil-off gas may already significantly reduce or even eliminate waste of boil-off gas.

The concept of the present disclosure is to capture a finite quantity of excess BOG for subsequent use. The objective of analysis is to identify the impact that systems of a range of capacities would have on overall consumption in the GCU.

Figure 8:
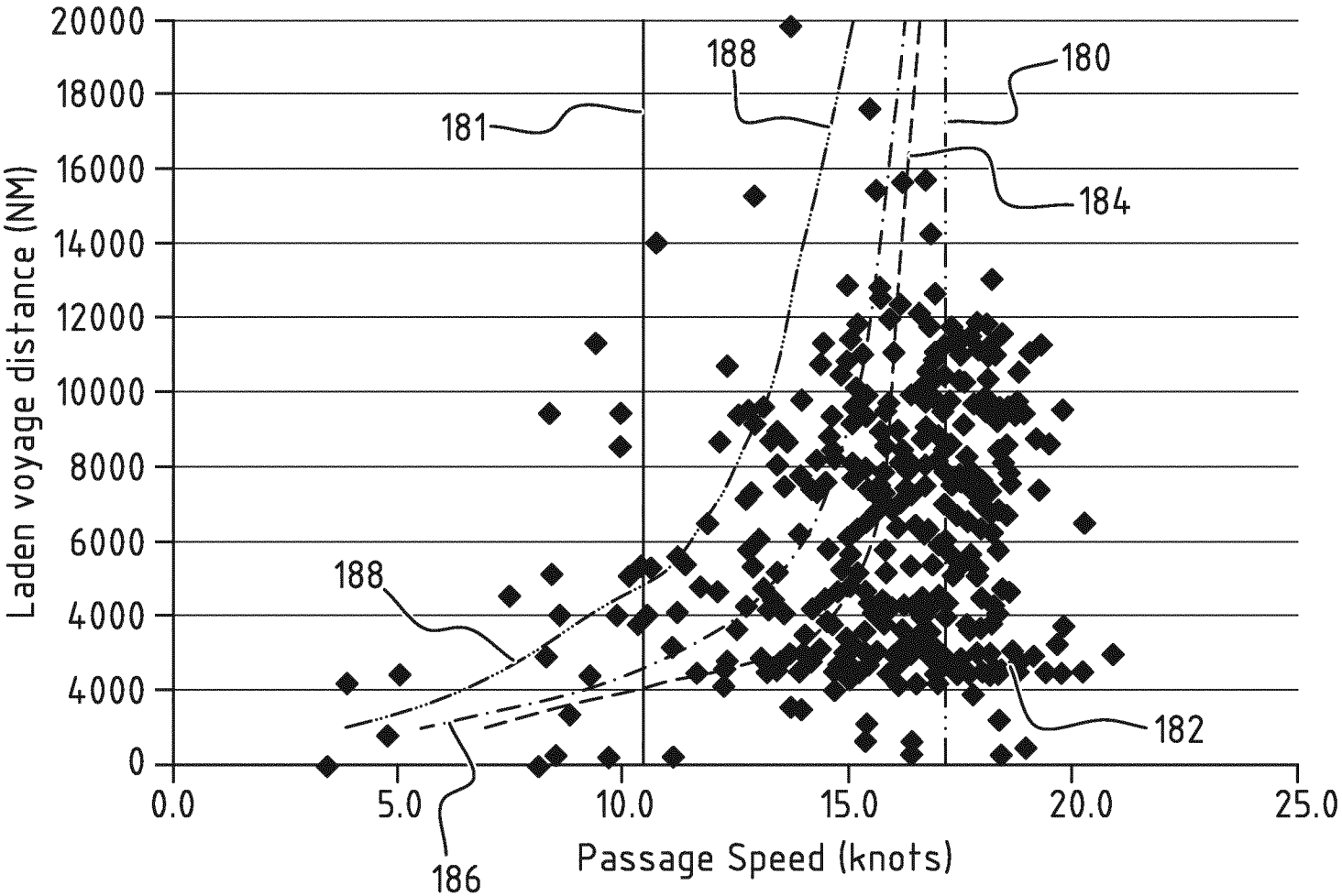
FIG. 8 shows an exemplary diagram of voyage length (y-axis; representing distance travelled per voyage) versus average speed (x-axis) for a number of voyages by conventional LNG carriers, compared to application of respective embodiments of an energy recovery system of the disclosure.

FIG. 8 shows an exemplary diagram of the impact of the system of the present disclosure, representing a plot of voyage length (Y-axis, expressed in laden voyage distance in nautical miles) vs. speed (x-axis, expressed in knots). The ability to recover a finite quantity of BOG will impact passages differently depending on their length and speed. Passages with a speed of over about 17.5 knots will have no requirement for the GCU, as indicated by operating line 180. Line 181 represents the hull optimum, i.e. an estimate of fuel demand for propulsion of a vessel, such as a DFDE powered vessel. A number of dots 182 indicate respective actual voyages of LNG carriers during a certain time period. On the plot of voyage length vs. speed, lines 184, 186 and 188 respectively indicate for total BOG storage volumes of 500, 1000 and 2000 m3 respectively, frame the operating envelope for the system of the present disclosure. Herein, for all dots 182 plotted to the right of a respective line 184, 186 and 188, the system of the disclosure including a combined BOG storage of 500, 1000 and 2000 m3, would allow to capture all surplus BOG for later re-use. Thus, the system of the disclosure would effectively eliminate BOG for all voyages plotted to the right of a particular line 184-188. For voyages plotted to the left of a respective line, the system will still allow to capture a significant part of the excess BOG per voyage.

Figure 9:
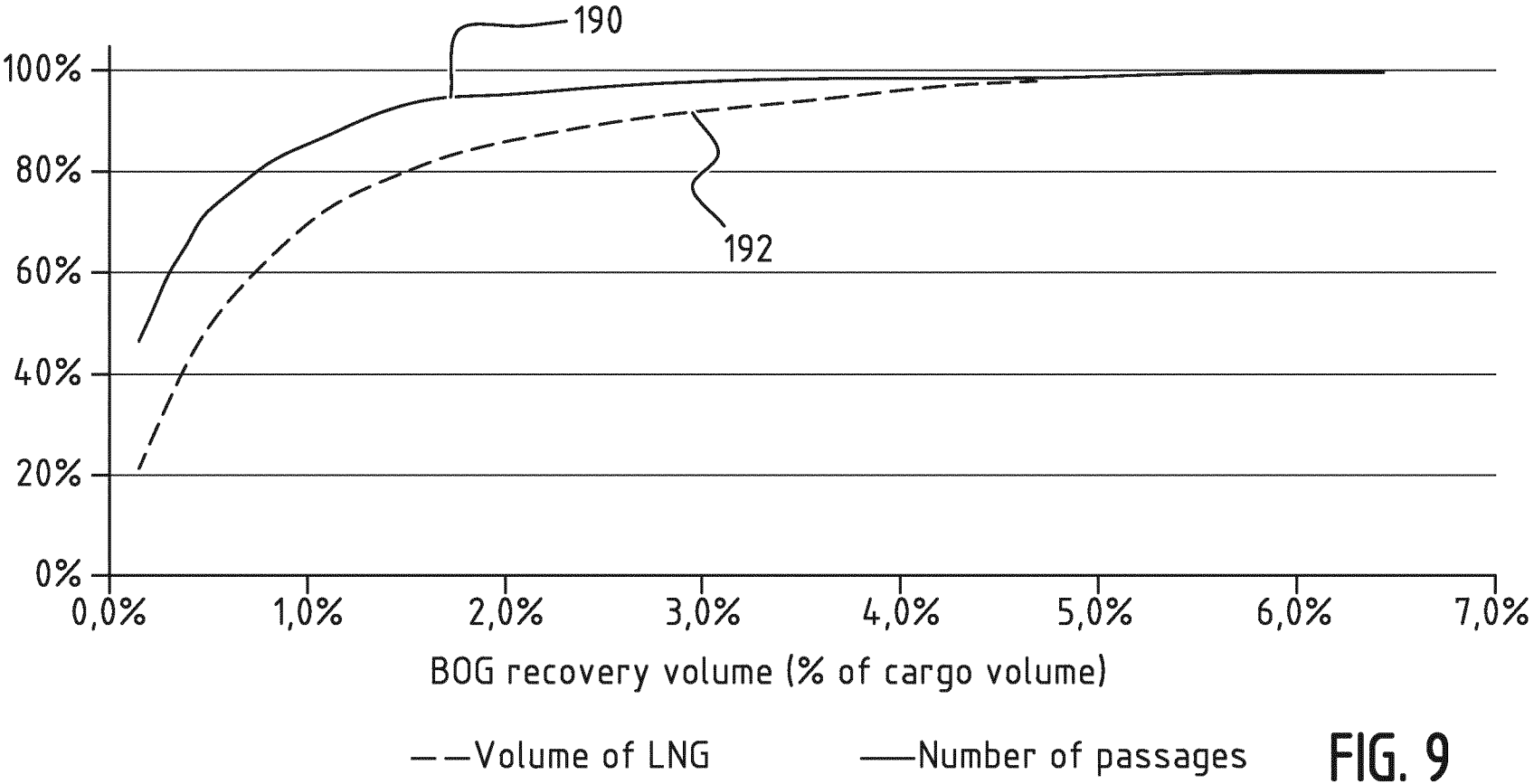
FIG. 9 shows an exemplary diagram indicating impact of the ability to recover BOG of systems of the present disclosure (in % on the vertical axis) versus the ratio of total volume of the recovery tank relative to the total volume of the cargo tanks (in % on the horizontal axis)

FIG. 9 shows an exemplary analysis of the ability of the system of the present disclosure to recover BOG, made on a basis of both the percentage of passages that will be completely captured (line 190), and the volume of LNG recovery that this opportunity size represents (line 192). The vertical axis indicates a percentage of total BOG volume recovered. The horizontal axis indicates the ratio of total volume of the recovery tanks 32 versus the total volume of the cargo tanks 50, expressed as a percentage.

This information can then be employed in calculating cost benefit figures for each opportunity size. FIG. 9 indicates that a relatively limited storage capacity of the recovery tanks may already provide significant benefits in recovering BOG and obviating losses. The system of the disclosure may provide significant benefit, with a total recovery tank volume in the range of about 0.5 to 5% of the total cargo volume.

Early calculations on stability and weight considerations indicate that at least up to a total additional storage of 1,500 to 2,000 m3 for BOG can be fitted on existing vessels, within design limits. This may typically fall well within the range wherein the system of the disclosure is beneficial, for instance within the 0.5% to 3% range compared to total storage volume. In a preferred embodiment, total recovery tank volume may be in the range of about 1% to 2% of the total cargo volume, to optimize investment versus merit. Minimal storage volume of BOG storage tank 32 may be at least 50 m3.

The system of the present disclosure may provide additional benefit with respect to retention of heel on the ballast passage. This will be elucidated referring to FIG. 10, after the following description of an exemplary cargo cycle to explain the meaning and function of heel.

A typical cargo cycle starts with the tanks 50 in a "gas free" condition, meaning the tanks are full of air, which allows inspection and maintenance on the tank and pumps.

Before LNG can be re-introduced to the tank 50 it is typically 'inerted' to eliminate the risks presented by an explosive atmosphere. An inert gas plant burns diesel oil in air to produce a mixture of gases (typically less than 5% O2 and about 13% CO2 plus N2). This is blown into the tanks until the oxygen level drops below 4%. An example of the inert gas composition is provided in table 1:

| Inert gas composition | |
|---|---|
| Oxygen | <1% in vol. |
| Carbon dioxide | <14% in vol. |

-continued

| Inert gas composition | |
|---|---|
| Carbon monoxide | <100 ppm in vol. |
| Sulphur oxides (SOx) | <1 ppm in vol. |
| Nitrogen oxiges (NOx) | <100 ppm in vol. |
| Nitrogen | balance |
| Dew point | <45° C. |
| Soot (on Bacharach scale) | 0 (complete absence) |

Next, the vessel goes into port to "gas-up" and "cool-down".

If the tank inerting has been completed using inert gas the cargo tanks are typically purge dried and cooled down before loading can commence. Inert gas contains 14% CO2 which freezes at −60° C. and can block, valves, filters, nozzles or result in cargo pump damage.

LNG is supplied to the vessel via the spray line to the main vaporiser, which boils off the liquid into gas. This is then warmed up to roughly 20° C. (68° F.) in the gas heaters and then blown into the tanks 50 to displace the "inert gas". This continues until all the gases liable to freezing have been removed from the tanks.

Now the vessel is gassed up and warm. The tanks are still at ambient temperature and are full of methane.

The next stage is cool-down. LNG is sprayed into the tanks via the spray header and spray nozzles, which vaporises and starts to cool the tank. The excess gas is again blown ashore to be re-liquified or burned at a flare stack. Cool down of the cargo tanks is typically considered complete when the mean temperature of the temperature sensors in each tank indicate a temperatures of −130° C. (−200° F.) or lower. Now, the tanks are ready to load bulk.

Bulk loading starts and liquid LNG is pumped from the storage tanks ashore into the vessel tanks. Displaced gas is blown ashore by the compressors. Loading continues until the tanks 50 are typically about 98.5% full (to allow for thermal expansion/contraction of cargo).

The vessel can now proceed to the discharge port, referred to as the laden passage. During passage various boil-off management strategies can be used, as explained above.

Once in the discharge port, the cargo is pumped ashore using the vessel's cargo pumps. As the tank 50 empties, the vapour space 84 is filled by either gas from ashore or by vaporising some cargo in the cargo vaporiser. Either the vessel can be pumped out as far as possible, or some cargo can be retained on board as a "heel".

It is conventional practice to keep onboard a small part, for instance about 5% to 10%, of the total cargo volume after discharge. This is referred to as the heel and this is used to cool down the remaining tanks that have no heel before loading. Heel can be spread across all tanks or consolidated in one or more cargo tanks. The heel volume retained will be based upon the ballast voyage length and/or speed and the specific fuel consumption of the vessel. Depending on voyage length, it may be common to spread the heel, i.e. the LNG, across all cargo tanks. Firstly to avoid the need for spraying but also because the total heel volume could exceed the lower fill limits of a single tank. Low fill limit is specified to avoid sloshing damage.

Cooling down the cargo tanks using the heel may be done gradually. One may aim to achieve a cargo tank temperature of, for instance, about −130° C. or lower. The same criteria as with cool down may apply, as mentioned above.

Cool-down can take roughly about 20 hours on a vessel with Moss type cargo tanks and 10 to 12 hours on a vessel provided with membrane type cargo tanks. So, carrying a heel allows cool-down to be completed before the vessel reaches port giving a significant time saving. The vessel arrives in a ready to bulk load condition.

If all the cargo is pumped ashore, then on the ballast passage the tanks will warm up, returning the vessel to a gassed up and warm state. The vessel can then be cooled again for loading using shore supplied LNG.

The system 30 of the disclosure is also able to provide storage for heel on Ballast passages, which will potentially allow a significantly reduced quantity of heel to be retained on completion of discharge. The main cargo tanks are then allowed to warm over the course of the Ballast passage, and spraying of the tanks is commenced 2 or 3 days prior to the scheduled loading date.

This allows the boil off volume in Ballast to be greatly reduced, as the heat ingress is only to a much smaller recovery tank 32, rather then the large volume of one of the main cargo tanks 50. In addition, the higher pressure rating of the recovery tanks 32 can be utilised to allow the pressure of the contents to rise slowly, thereby obviating any Boil Off gas.

The key parameter for operation of LNG carriers in Ballast is for the vessel to present at load port cold, i.e. with pre-cooled cargo tanks. The cargo tanks are generally kept cold by the retention of a reduced quantity of LNG, termed heel, as described above.

Current heel management strategies have been very successful in reducing heel quantities, but not eliminating the requirement to have heel entirely. The quantity of heel required is typically vessel LNG capacity specific. The quantity of heel required may be, for instance, in the range of approximately 50 to 100 m3 for each day duration of the Ballast passage. These metrics may differ, and are typically LNG cargo volume specific.

In a practical embodiment, the retention of a total quantity of about 900 m3 of LNG would be sufficient to carry out the cooldown of the cargo tanks 50 from ambient temperature, for a modern DFDE/TFDE powered LNG carrier with total storage capacity in the order of 178,000 m3. The storage of this heel in the recovery tank 32 of the system of the disclosure, insulated to about the same standard as the main cargo tanks 50, can reduce the daily Boil Off Rate to about 2 m3 per day or less. When allowing the system 30 to use the full pressure range of the recovery tanks 32, the BOG loss may be obviated substantially entirely on ballast passages as well.

Figure 10:
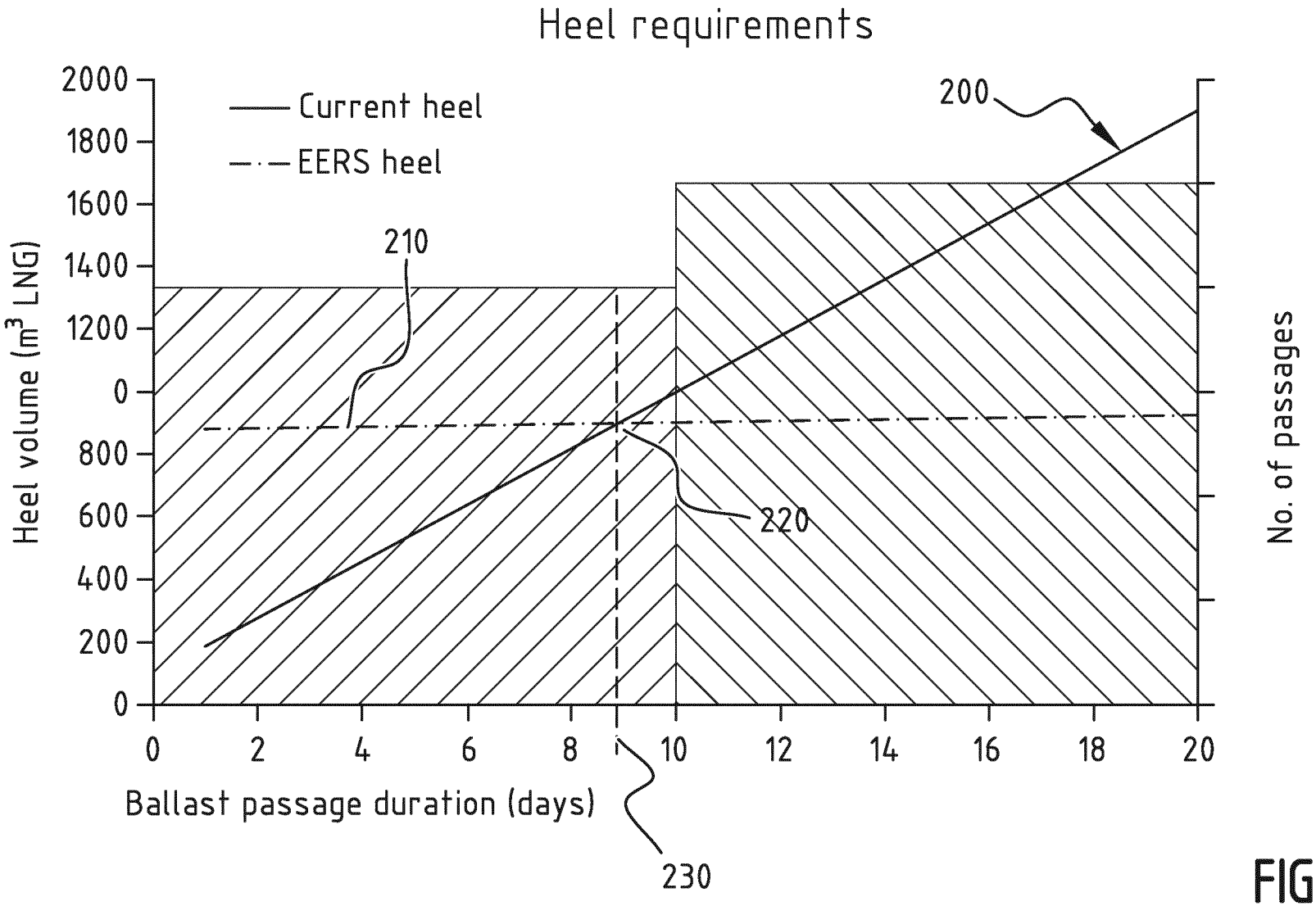
FIG. 10 shows an exemplary diagram indicating heel volume (y-axis) versus ballast voyage duration (x-axis) of conventional LNG carriers compared to carriers provided with an energy recovery system of the disclosure.

FIG. 10 shows an exemplary diagram, indicating current heel volume requirements 200 (vertical axis, expressed in m3 LNG) versus duration of a ballast passage (horizontal axis, expressed in days) for a typical LNG carrier. Using the system of the disclosure, available heel volume 210 can be substantially unchanged throughout the ballast passage. This means there is a cross over point 220 and a corresponding threshold duration 230 of the ballast passage. For passages having a duration exceedings the threshold 230, using the system of the disclosure to hold a predetermined heel volume will be beneficial.

For instance, for large LNG carriers, such as membrane tank carriers having a total cargo volume in the order of about 150,000 to 190,000 m3, ballast voyages that are more than a threshold of, for instance, 10 days in duration will require less heel if it is held in the recovery tanks 32 than keeping heel in (one of) the main cargo tanks 50. This introduces an extra option for passages over said threshold duration, such as 10 days, when the vessel is required to arrive cold. The management of fuel quantities for the Ballast passage can be separated from the need to arrive cold, and depending on the voyage length and the relative price of Fuel Oil and LNG may offer savings on the Fuel costs and CO2 for the Ballast passage.

Examination of fleet data in 2016 reveals that over half of the Ballast passages were greater than the threshold duration, and so potentially candidates for this approach.

The heel retained at the discharge port may contain heavier hydrocarbons, principally Ethane, Propane and Butane. The heel may comprise as much as 6% of heavier hydrocarbons. The lighter fractions of the heel, principally Methane, will evaporate first, thereby enriching the remaining heel with the heavier components. On longer Ballast passages, a position may be reached where the bulk of the heel remaining is comprised of heavier fractions.

This a phenomenon that particularly affects TFDE and DFDE vessels, as these heavier components cannot be consumed by the TFDE/DFDE engines, and these are removed from the BOG flow in the Fuel Gas compressor suction and returned to the cargo tanks. Steam vessel boilers are able to consume these heavier fractions, but on TFDE/DFDE vessels the volume of heel remaining towards the end of a longer Ballast passage has a very high percentage content of heavy fractions and effectively becomes 'dead heel'. Examination of fleet data in 2016 revealed that the quantity of heavy fractions can exceed 450 m3 on a single ballast passage.

These heavier fractions will not provide any cooling effect or fuel source and so can only be processed through the GCU. The retention of much smaller quantities of heel mean that the volume of heavier components is reduced, hence the accumulation of significant volumes of heavier components does not arise.

The higher pressure rating of the EERS recovery tanks 32 has an additional benefit in that the pressure of the recovery tank 32 can be allowed to rise, thereby meaning there is no flow from the tank and no enrichment takes place in this mode of operation.

The system and method of the present disclosure may at least in part obviate the loss of LNG cargo as described above. The system of the disclosure can be retrofitted to existing vessels. Also, the system is relatively inexpensive and robust due to the limited number of components.

By adding and extrapolating to the entire fleet chartered by applicants, and weighting to take account of the remaining charter period for each vessel, the potential prize across the entire fleet for the associated charter periods is an estimated recovery of significant amounts of LNG. This would significantly reduce associated CO2 emissions and save lost LNG sales against a 'do nothing' scenario wherein the LNG would be lost as boil off gas.

The benefit derived from the use of the BOG recovery tank 32 and system 30 will depend on the relative price of HFO and Gas, the voyage length and voyage speed. Voyages which will particularly benefit are those with a long duration but short distance, including periods at anchor or drifting.

The use of the recovery tanks 32 could remove the contingency amount of fuel required to allow for adverse weather, removes the need to allow for dead heel, removes the need for GCU operation at low loads (speeds) or drifting, and removes the operator experience factor in determining heel retention quantities.

Examination of the fleet in 2016 to end August indicates that based on the project precepts, on 24 of the 25 Ballast passages over the threshold in duration, savings could have been made with the system of the disclosure. This mode of operation may increase annual outturn per vessel, for instance by at least 8,000 m3 of LNG, and may reduce the annual volume sent to the GCU per vessel by, for instance, at least 1,700 m3 of LNG.

The present disclosure provides a method and system comprising the application of an Excess Energy Recovery System (EERS) applicable to modern LNG carriers using TFDE (Tri Fuel Diesel Electric), DFDE (Dual Fuel Diesel Electric) and XDF (X Type Dual Fuel) propulsion systems. The design aims to harvest and store the excess gas when it is not required and release it to the propulsion plant when it is needed, thereby eliminating waste energy and also avoiding additional use of fuel oil.

The EERS system of the present disclosure reduces unnecessary consumption on Laden passages at speeds below the speed at which all of the BOG is consumed by the engines.

In addition, the system 30 of the disclosure allows heel quantities to be significantly reduced on longer Ballast passages, thereby allowing the voyage speed to be set independently of the requirement to keep the cargo storage tanks, i.e. the containment system, cold. This function is of particular benefit when the loading port and dates may not be fixed at the completion of discharge.

The system and method of the disclosure provide for instance the following advantages and features:

Cleaner powered shipping with improved fuel efficiency and operational speed flexibility;

Maximizing LNG out-turn for the lowest possible operational costs;

Minimise harmful emissions and comply with today's stringent and expected future legislation. Reduced NOx, SOx, CO2 and particulate matter;

Easy to implement and market, as the system can be retrofitted to existing vessels. The system provides a cost effective solution;

Minimise consumption of petroleum distillate fuels;

Deliver a step change in vessel performance and a competitive advantage to the operator of the vessels.

EERS does not introduce any new technologies.

The EERS pipeline layout is designed with minimum modification to the existing cargo piping arrangement. The pipelines associated with EERS will where possible follow existing pipeline routes.

The EERS aims to harvest and store the excess gas when it is not required and release it to the plant when it is, thereby eliminating energy waste, release of harmfull emmissions and also avoiding additional use of liquid fuel oil.

The EERS installation shall utilise the existing fuel gas compressors and LNG spray pumps in cargo tanks. The EERS shall be designed to operate within the design parameters of the relevant existing equipment.

The EERS pipeline lengths shall be as short as is practical to minimize CAPEX, in service maintenance, weight and pipeline boil off.

The EERS system shall be designed such that it benefits from the LNG carriers existing vessel utilities and control systems.

EERS shall be designed to use existing LNG gas handling equipment for Engine room machinery.

The EERS will be installed in the cargo area and hence in a hazardous area, as shown in FIGS. 4-7. Equipment will be designed for Zone 1 and protection techniques and certification will be consistent with existing equipment in the cargo area.

EERS materials, machinery, equipment and outfit shall use normal shipbuilding and marine engineering quality complying to the IGC 2016 code and IACS requirements.

Pipeline design material 304L & 316L are compatible with existing EERS system materials and comply with the Maritime DEC standards. For costing purpose, 316L material has been considered.

The EERS system may be designed to be capable of processing 50% of the Boil Off Gas flow rate from the containment system during laden passage. As a highest case the contractual BOR of 0.128% may be taken. In practice, the EERS system 30 may be designed to manage a recovered LNG storage capacity of between 500 m3 and 2,000 m3, for instance about 1,000 m3 of recondensed BOG.

A swot analysis was carried out for two principal Type C LNG tank insulation systems, Vacuum perlite & PU Foam, to be used as recovery tank 32 for the system 30. Based on the findings, it is concluded that the vacuum insulated tanks are favoured, this conclusion being driven by the superior boil off performance. The ranking exercise reveals that there is little overall difference in the relative merits of the two containment systems, with benefits in some areas being outweighed by lower relative performance in the other.

The interaction of the motion of the ship and the free surface of the liquid in the type C tank can lead to the build-up of large waves inside the type C tank which can impact the ends of the type C tank with considerable force. The likelihood of occurrence and magnitude of any impact are functions of the tank C tank dimensions and the size of the supporting ship. This phenomenon may be mitigated through installation of swash bulkheads inside the recovery tank 32 to reduce the span of the free surface.

DNV Classification note 31.13 provides guidance on sloshing analysis requirements based on the size of the type C tank compared with the size of the vessel. This guidance states that if the type C tank is less than about 16% of the length of the ship, neither a sloshing analysis, nor swash bulkheads are required.

The proposed arrangement, see FIGS. 4-7, uses recovery tanks 32 with a length of, for instance, 24 m on a vessel of an LBP of 274 m, making the recovery tanks in the order of 8 to 9% of the length of the ship and well outside of the range considered to require sloshing analysis work.

In a practical embodiment, the system 30 of the disclosure has a transfer pump 36 for each recovery tank 32 to transfer the condensed BOG to cargo tanks 50 or an LNG vapouriser. These pumps 36 may be electrically driven centrifugal cryogenic service pumps similar to LNGC cargo tanks stripping pumps. Typical design capacity may be in the order of 50 m3/hr.

The EERS system 30 will preferably require to interface with the existing liquid and vapour pipework systems of the vessel, principally cargo vapour header, spray header and Engine room fuel gas supply system. See FIG. 3.

Safety valves for storage tanks may require piping to riser masts as provided for other cargo system safety valves.

The pipes comprised in the system 30 can be of varying sizes for Cryogenic media, some liquid and some gaseous. The pipelines can be located on the main deck. The pipe sizes may be kept as close as possible to the LNGC interface pipe sizes. Stainless steel grades 304L & 316L are suitable, with 316L being the preferred material for this service.

Exemplary thermodynamic assessment.

The carriage of LNG at very low temperatures gives rise to heat ingress from the relatively warm surroundings to the cold liquid. This heat inflow is balanced thermodynamically by the removal of vapour in the form of Boil Off Gas (BOG), and thereby cooling due to the Latent Heat of Vapourisation. The vapour in the tanks 50 is typically superheated, for instance to approximately −130° C., but the exact temperature will depend on the BOG removal flow rate, with lower flow rates resulting in warmer gas temperatures.

The BOG can be used as fuel gas by steam boilers or diesel engines. In a vessel equipped with reliqefaction plant the BOG can be re-condensed, rejecting heat to a refrigerant cycle.

The refrigerant cycle requires prime movers of high power as the thermal efficiency of the available cycles is typically around 15%, due to the very low temperatures. The refrigerant also requires to reject heat to a high temperature sink, usually cooling fresh water, at approximately 6 times the cooling effect. This heat ultimately must be rejected to sea water, leading to significant heat exchangers and cooling water flows.

The core of the system 30 of the present discosure is effectively to capture part of the heat ingress by allowing the pressure of part of the BOG to rise in a separate receiver 32, and making use of the rise in enthalpy that this represents.

The system 30 may not be able to absorb all of the heat ingress, and the remaining heat will need to be absorbed in a heat sink. The heat sink may be formed by the bulk liquid cargo 82.

A preferred concept is to indirectly cool the BOG using LNG. To cool indirectly means that the system 30 only needs to have the capacity to store condensed BOG in recondenser 34, see FIG. 3.

The operation of LNG vessels in the Laden condition is principally concerned with maintaining the cargo tank vapour pressure within boundaries, and this generally results in a small rise in temperature of the cargo over the course of a Laden passage.

Increasing the pressure of the BOG using the system of the present disclosure may not absorb all of the energy it contains, and some heat rejection to the liquid cargo 82 may be necessary.

Examining available records, the average temperature of cargoes loaded was −159.56° C., and the average of cargoes discharged was −159.5° C., a modest rise of 0.06° C. Voyage specific data indicates a maximum temperature rise over the course of a Laden passage of 0.3° C.

There are cargoes delivered at temperatures greater than −159° C., with the highest reported temperature being about −158.2° C.

There is only one terminal which actually specifies a maximum arrival temperature, Dubai, at −159° C., other terminals specify a maximum tank pressure of 1,100 to 1,200 mBar, which equates to a range of temperatures of −159.1° C. to −159.4° C.

Empirical evidence is that terminals prefer lower temperatures and pressures, but it is not definitively established that these are stipulations rather than preferences.

The recovery of 1,000 m3 BOG, i.e. using a system 30 of the disclosure having recovery tanks 32 with total storage of about 1,000 m3, may have the impacts on the temperature of the bulk cargo temperature as indicated in Table 2:

TABLE 2

| Recovery pressure | Storage pressure | Rate of rise per day at 50% of 0.08% BOR for cargo (° C./day) | Rate of rise per day at 50% of 0.10% BOR for cargo (° C./day) | Rate of rise per day at 50% of 0.12% BOR for cargo (° C./day) | Cargo temp. rise for 1,000 m3 tank 32 (° C.) |
|---|---|---|---|---|---|
| 6 Bara | 6 Bara | 0.104 | 0.083 | 0.125 | 1.315 |
| 11 Bara | 11 Bara | 0.096 | 0.077 | 0.115 | 1.208 |

TABLE 2-continued

| Recovery pressure | Storage pressure | Rate of rise per day at 50% of 0.08% BOR for cargo (° C./day) | Rate of rise per day at 50% of 0.10% BOR for cargo (° C./day) | Rate of rise per day at 50% of 0.12% BOR for cargo (° C./day) | Cargo temp. rise for 1,000 m3 tank 32 (° C.) |
|---|---|---|---|---|---|
| 21 Bara | 21 Bara | 0.100 | 0.080 | 0.120 | 1.253 |
| 6 Bara | 11 Bara | 0.086 | 0.069 | 0.103 | 1.086 |
| 6 Bara | 21 Bara | 0.076 | 0.061 | 0.091 | 0.950 |

The containment system operating pressure range is approximately 150 mbar between low and high pressure alarm points, and these technical limits on the containment system equate to a maximum 1.5° C. range of temperature that can be allowed (i.e. maximum allowed temperature increase of liquefied gas stored in the main storage tank(s) 50).

The core principal of storing heat energy in a vessel 32 which is held at a higher pressure than the containment system 50 is thermodynamically viable. The temperature rise of 1.3° C. required for a system operating and storing at 6 Bara is within the limits of the 1.5° C. available.

The operation of the recondenser 34 at about 6 Bara and storage in recovery tank(s) 32 at increased pressure, for instance about 8 through 11 Bara or more, allows the temperature increase of the bulk cargo 82 to be limited to about 1.1° C. for a target recovery volume of 1,000 m3 (i.e. the capacity of BOG storage tank 32), which allows more margin to the 1.5° C. available. This is offered as a recommended option on thermodynamic grounds.

The dissipation of the heat from the cooling process represents a modest rate of increase in the temperature of the entire cargo volume. The increase in temperature of the bulk liquid cargo is a deviation from current practice, but lies within the technical operating parameters of the vessel and containment system.

The system 30 can be sized for 50% of BOG flow whilst remaining with the capacities of existing machinery, regardless of which recovery and storage pressure options are chosen. The system 30 therefore provides a relatively simple and inexpensive solution to retrofit on existing vessels.

The one or more BOG storage tanks 32 of the disclosure can be loaded with LNG, independently from the main cryogenic storage tanks 50. Liquefied gas, typically LNG, may for example be transferred to the BOG storage tank 32 from road tankers or LNG bunker vessels, without the need for the main cargo tanks 50 to contain gas or be cold.

The BOG storage tank 32 can be isolated from the cargo system 50, via valves (indicated in FIG. 3 and on pump 36). Thus, the BOG storage tank 32 can be charged with LNG even if the main cargo system 50 is gas free. This provides a significant advantage on unladen voyages. The system 30, including the BOG storage tank 32, is an active system, and so can be used as a source of gas from LNG (for instance vaporized gas 44 to the engine 52). The system 30 may also receive gas or liquid from the cargo system 50.

Calculations indicate that the system of the disclosure is the best option available, which provides a viable option to address the imbalance between containment system and propulsion plant in the Laden condition.

The system 30 of the disclosure and alternatively reliquefaction are the only options which provide solutions to reduce the heel quantity on Ballast passages. However, the system 30 of the present disclosure has a significant advantage over reliquefaction in that it does not require machinery operation and fuel consumption.

Also, the system 30 of the disclosure compares favourably with any other option available, both with respect to upfront capital expenditure (CAPEX) and operating costs (OPEX).

For instance, a reliquefaction system using a Turbo Brayton cycle is significantly more expensive, both in capex and opex (due to energy consumption of the reliquefaction cycle).

The system 30 of the disclosure may only require a limited investment. Also operating expenditures may be relatively limited. Compared to reliquefaction, the system of the disclosure may be at least 2 times, but potentially at least 3 to 4 times, cheaper both to build and to operate. The system of the disclosure can be retrofitted to existing LNG carriers relatively easily.

Abbreviations used throughout the description may include one or more of the following table 3:

TABLE 3

| | |
|---|---|
| BOG | Boil Off Gas |
| BOR | Boil Off Rate |
| CNG | Compressed Natural Gas |
| DCS | Distributed Control System |
| DFDE | Dual Fuel Diesel Electric |
| EERS | Excess Energy Recovery System |
| GCU | Gas Combustion Unit |
| HFO | Heavy Fuel Oil |
| IACS | International Association of Classification Societies |
| IGC | International Code of the Construction and Equipment of Ships Carrying Liquefied Gases in Bulk |
| IGF | International Code of Safety for Ships using Gases or other Low-flashpoint Fuels |
| LBP | Length Between Perpendicular |
| LNG | Liquefied Natural Gas |
| LNGC | Liquefied Natural Gas Carrier |
| MARPOL | International Convention for the Prevention of Pollution from Ships |
| ME-GI | Main Engine - Gas Injection |
| PRS | Partial Re-liquefaction System |
| TFDE | In Fuel Diesel Electric |

The present disclosure is not limited to the embodiments as described above, wherein many modifications are conceivable within the scope of the appended claims. Features of respective embodiments may for instance be combined.

That which is claimed is:

1. A method for the transport of liquefied gas, comprising:

transporting liquefied gas in a vessel, the vessel comprising:

a hull, at least one cargo storage tank arranged in the hull for storing liquefied gas, at least one engine to propel the vessel;

receiving boil-off gas at a compressor inlet of at least one compressor, the compressor inlet connected to a vapour space of the at least one cargo storage tank, at a first pressure ($P_1$);

using the compressor to supply pressurized boil-off gas to the at least one engine at a second pressure ($P_2$) exceeding the first pressure;

diverting at least part of the pressurized boil-off gas to a boil-off gas recovery system for recovery of boil-off gas;

recondensing the at least part of the pressurized boil-off gas in a cooling section of the BOG recovery system to provide recondensed pressurized boil-off gas;

storing the recondensed pressurized boil-off gas in at least one recovery tank, wherein the recovery tank having a total volume for storing the recondensed pressurized boil-off gas being in the order of about 0.5% to 5% of the total volume of the at least one cargo tank.

2. The method of claim 1, comprising the further step of:

providing vaporized boil-off gas from the at least one recovery tank to the at least one engine.

3. The method of claim 1, further comprising:

operating the recondenser at a third pressure ($P_3$) being substantially the same or lower than the second pressure ($P_2$).

4. The method of claim 3, further comprising:

providing the recondensed pressurized boil-off gas at a fourth pressure ($P_4$), the fourth pressure exceeding the third pressure ($P_3$), to a secondary pre-cooler inlet for heat exchange of the recondensed pressurized boil-off gas against the pressurized boil-off gas.

5. The method of claim 1, wherein the storing step comprises: storing the recondensed pressurized boil-off gas in the at least one recovery tank at a storage pressure in a range from 6 bar and up to 25 bar.

6. The method of claim 1, wherein the storing step comprises: storing the recondensed pressurized boil-off gas in at least one recovery tank for a period of at least one day.

7. The method of claim 6, wherein the storing step comprises: storing the recondensed pressurized boil-off gas in at least one recovery tank for a period of at least 9 days.

8. The method of claim 7, wherein the storing step comprises: storing the recondensed pressurized boil-off gas in at least one recovery tank for a period of at least 10 days.

9. The method of claim 8, wherein a secondary pre-cooler outlet being connected to the recovery tank inlet.

* * * * *